US005325119A

United States Patent [19]

Fong

[11] Patent Number: 5,325,119

[45] Date of Patent: Jun. 28, 1994

[54] VARIABLE RATE SPRING INK PRESSURE REGULATOR FOR A THERMAL INK JET PRINTER

[75] Inventor: Jon Fong, Coral Gables, Fla.

[73] Assignee: Hewlett-Packard Company, Palo Alto, Calif.

[21] Appl. No.: 928,904

[22] Filed: Aug. 12, 1992

[51] Int. Cl.[5] ..... B41J 2/175

[52] U.S. Cl. ..... 347/86

[58] Field of Search ..... 346/140 R, 75; 400/126

[56] References Cited

U.S. PATENT DOCUMENTS 4,412,232 10/1983 Weber et al. ..... 346/140 R
4,422,084 12/1983 Saito ..... 346/140 R
4,503,443 3/1985 Dagna et al. ..... 346/140 R
4,992,802 2/1991 Dion et al. ..... 346/1.1

*Primary Examiner*—Benjamin R. Fuller
*Assistant Examiner*—N. Le

[57] ABSTRACT

An ink pressure regulator system disposed inside of a flexible ink bag reservoir for a replaceable or refillable computer driven printer ink cartridge comprises a pair of parallel piston plates and a spring system therebetween having a variable spring function relating force to displacement of the spring such that the regulator collapses to a substantially flat shape under decreasing amounts of added spring collapsing force as the plates approach each other to allow substantially complete evacuation of ink from the bag.

7 Claims, 3 Drawing Sheets

FIG. 5
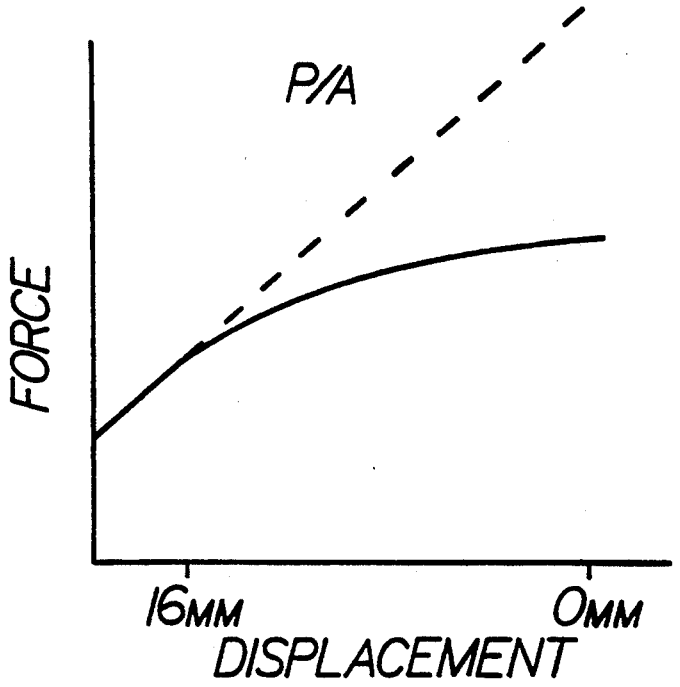
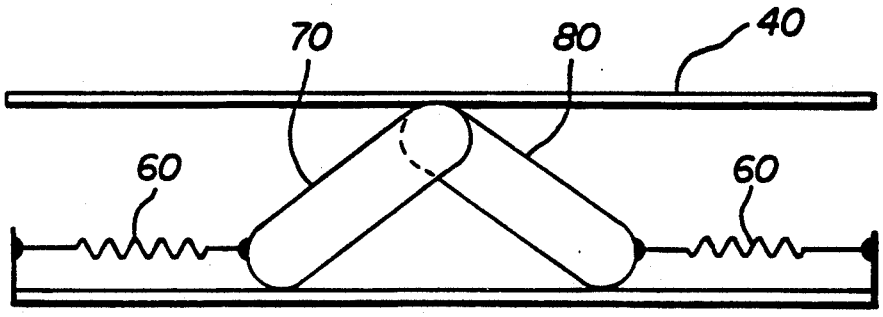
FIG. 6

VARIABLE RATE SPRING INK PRESSURE REGULATOR FOR A THERMAL INK JET PRINTER

BACKGROUND OF THE INVENTION AND PRIOR ART

The present invention relates generally to ink reservoirs for high speed computer driven inkjet printers and plotters and other applications where precise pattern dispensation of a fluid is required such as the layout of circuit masks. In such printers the ink reservoir is ordinarily maintained under a sub-atmospheric or negative pressure so that ink will not leak or drool from the printhead. Various types of ink reservoirs may be used including refillable ink reservoir cartridges which are mounted on the moveable printer carriage, throwaway replaceable cartridges which are mounted on the printer carriage and remote or offboard ink reservoirs from which ink is pumped to the print head by tubing. In the onboard refillable or throwaway cartridges, a polymer foam is ordinarily provided in the ink reservoir so that the capillary action of the foam will prevent ink from drooling from the printhead. Polymeric foams of the type typically used for this purpose are non-biodegradable and thus cause environmental problems whenever a previously used cartridge is emptied and thrown away. In addition, the use of industrial foam in the ink reservoir restricts the operating pressure range of the ink cartridge and such foam ordinarily leave a chemical residue which is incompatible with and/or reacts adversely with printer ink. Similarly, the relatively long tubing used to convey ink from an offboard pressure reservoir to a printing head does not lend itself well for different printing pressure ranges.

A collapsible ink reservoir for an inkjet printer is disclosed in U.S. Pat. No. 4,422,084 issued Dec. 20, 1983 to Saito. Negative pressure is maintained in a polypropylene ink bag by a spring which biases the bag walls apart from each other.

One example of an onboard ink pressure reservoir cartridge is disclosed in U.S. Patent Application Ser. No. 07/717,735 filed Jun. 19, 1991 entitled SPRING-BAG PRINTER INK CARTRIDGE WITH VOLUME INDICATOR filed by David S. Hunt and W. Bruce Reid and assigned to the assignee of the present invention. The cartridge disclosed in that application basically comprises a rectangular housing containing a flexible bag of ink and an ink filter and a printhead which receives ink from the filter. A spring inside of the bag of ink urges its flexible walls apart from each other thus maintaining a negative or sub-atmospheric pressure in the reservoir which is overcome as ink is emitted from the printhead. Cartridges of this type, while well suited for their intended purpose, suffer from the disadvantage that ink is not always completely used since the spring occupies a certain volume of space inside of the ink bag. As seen in that application, the spring essentially consists of a pair of spaced parallel plates which are urged apart by a spring.

Also of interest is the disclosure owned by the assignee of the present invention titled INK PRESSURE REGULATOR FOR A THERMAL INK JET PRINTER filed on Aug. 12, 1992 by George Kaplinsky and Tofigh Khodapanah, the disclosure of which is hereby incorporated by reference and which discloses various spring configurations for use in pressure regulators.

Experience has shown that despite use of the spring arrangements mentioned above, after the spring is substantially collapsed, a small amount of residual ink remains in the ink bag which is never used. Accordingly, further spring designs have been investigated with the objective of further minimizing the amount of residual ink left stranded in the cartridge after full collapse of the ink bag.

SUMMARY OF THE INVENTION

The present invention provides a pressure regulator system for a liquid ink cartridge having an ink reservoir to be maintained under negative pressure, said regulator system comprising:

a) a pair of spaced substantially parallel flat side plates respectively engageable with moveable walls of said reservoir; and b) a spring system urging said plates apart from each other, said spring system having a variable spring function f(x) in the spring equation $F=f(x)x$ which increases with travel of the plates toward each other where F is spring force and x is spring deflection.

The present invention further provides a printer ink cartridge comprising a rigid housing containing an ink reservoir to be maintained under negative pressure, said reservoir having at least one flexible wall and an ink pressure regulator system in said ink reservoir, said regulator system comprising: a) a pair of spaced substantially parallel flat side plates respectively engageable with substantially parallel moveable walls of said reservoir; and b) a spring system urging said plates apart from each other, said spring system having a variable spring function f(x) in the spring equation $F=f(x)x$ which increases with travel of the plates toward each other where F is spring force and x is spring deflection.

BRIEF DESCRIPTION OF THE DRAWING

FIG. 5 is a graph plotting the spring force vs. displacement characteristics of pressure regulators of the present invention as compared with the prior art.

FIG. 6 is a schematic representation of a different embodiment which is essentially the mechanical equivalent of the embodiment of the invention shown in FIGS. 2–4.

DESCRIPTION OF THE PREFERRED EMBODIMENT

Figure 1:
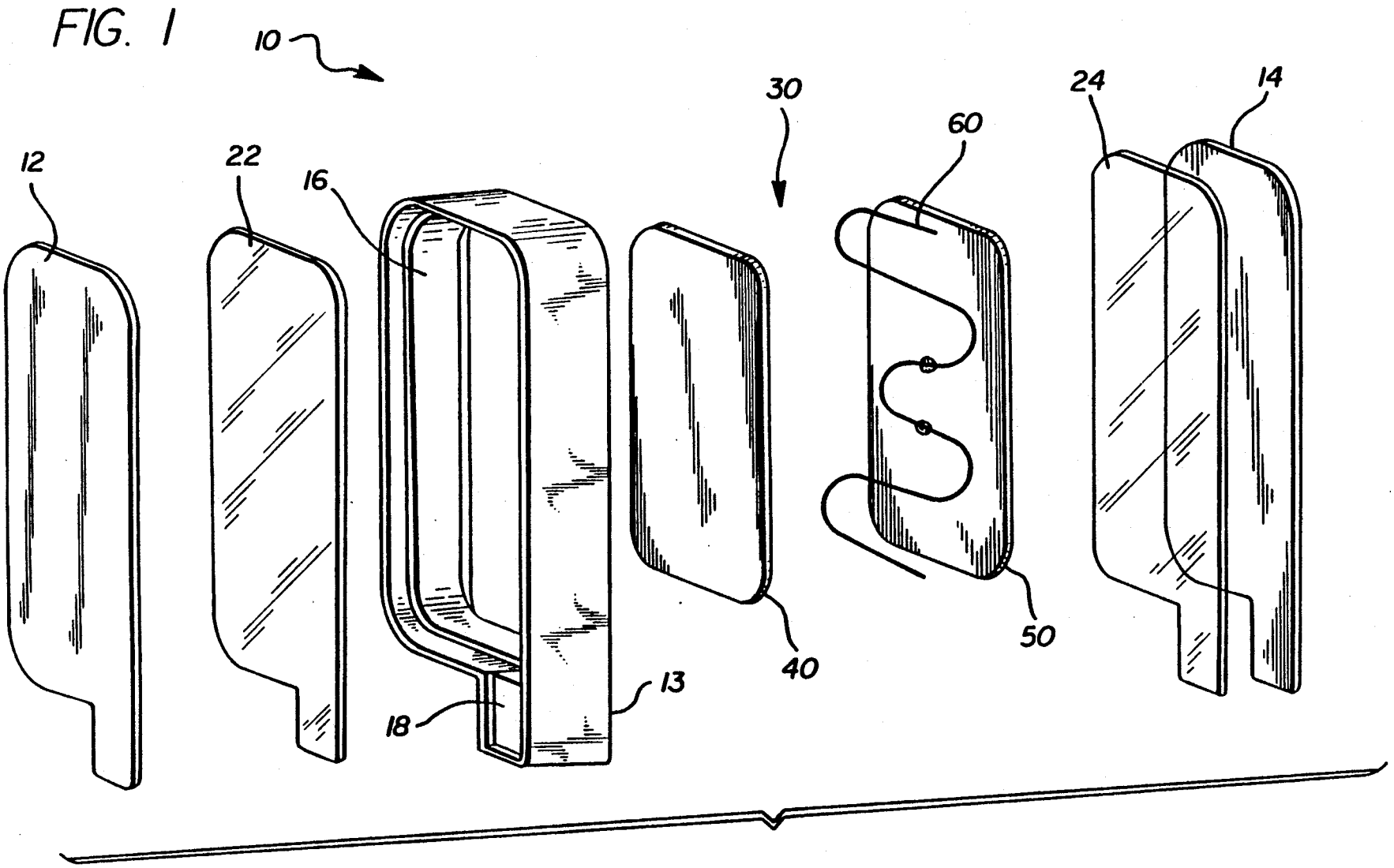
FIG. 1 is an exploded perspective view of a replaceable or throwaway ink cartridge for a thermal inkjet printer.

The replaceable ink cartridge in which the present invention is used is seen in FIG. 1 to comprise a rigid housing 10 having a pair of spaced cover plates 12, 14 intended to be affixed as by cementing to opposite sides of a plastic peripheral wall section 16. Snout portion 13 of the cartridge has an ink discharge aperture in its lowermost end wall (as seen in FIG. 1) to which is affixed an electrically driven print head, not shown.

A flexible ink reservoir bag comprising a pair of membranes 22, 24 which are joined together at their peripheral edges to each other and to the inside of wall section 16 of the reservoir contains a pressure regulator 30 which in turn is comprised of a pair of spaced parallel plates 40, 50 urged apart by a wire spring 60 which is bent to a generally serpentine configuration as discussed below and affixed to the end portions of the plates by welding or clip retainers. The plates 40, 50 are urged apart by the spring into engagement with the flexible reservoir wall membranes 22, 24. The snout portion 13 of the housing 10 also contains an ink filter 18 which is placed in fluid communication with the flexible bag ink reservoir by suitable porting which has an ink outlet in fluid communication with the printhead.

The pressure regulator side plates 40, 50 are each of generally rectangular configuration with rounded corners to avoid damaging the flexible bag membranes.

As the regulator is assembled into an ink cartridge, the regulator is collapsed partially such that it initially occupies a prestressed condition inside the ink bag in the cartridge housing. The amount of this prestressing is readily controllable by the designer by selecting the diameter or thickness of the spring wire and the desired degree of curvature to which the spring 60 is bent.

As ink is withdrawn from the reservoir bag, the flexible sidewalls 22, 24 of the bag and the pressure regulator sideplates 40, 50 gradually move towards each other whereby the pressure regulator is allowed to collapse to a substantially flat configuration. This permits virtually all of the ink in the reservoir to be used before the reservoir is discarded or refilled, as the case may be. Typically, a back pressure, i.e., negative pressure of about $-1$ to $-5''$ of water is maintained in the reservoir by regulator springs of this type. During assembly of the spring into the ink bag, the spring 60 will be prestressed the amount necessary to attain the desired amount of back pressure.

Figure 2:
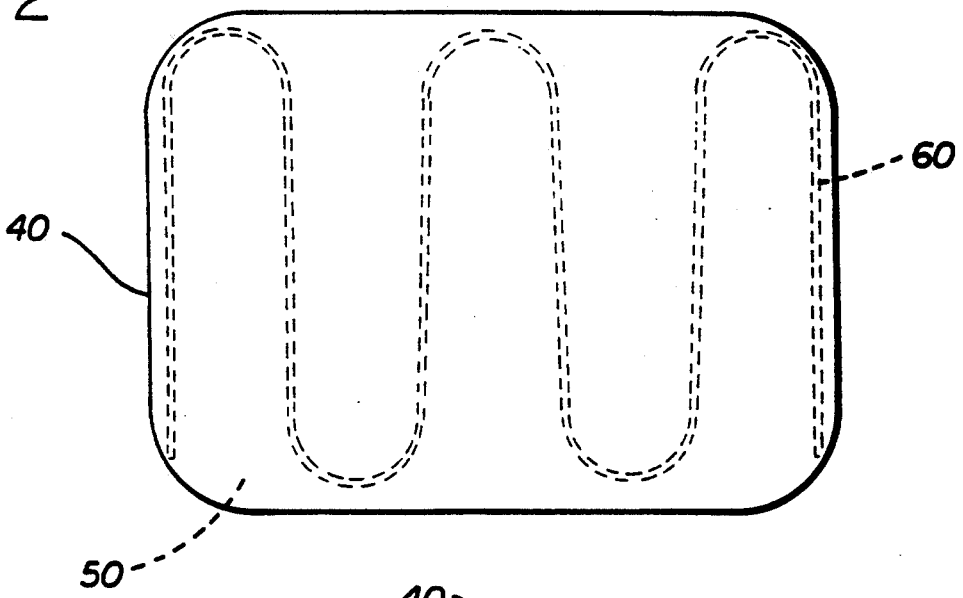
FIG. 2 is a plan view of a pressure regulator incorporating the teachings of the present invention

FIG. 2 is a plan view of the preferred embodiment of the invention using a serpentine spring 60 disposed between the regulator plates 40, 50. The regulator is constructed such that regulator collapsing force is non-linear due to the system geometry which, instead of the usual spring constant, has a variable spring function which relates force to displacement by the equation $F=f(d)d$ where $f(d)$ is the variable spring function and d is the displacement. The collapsing force F is relatively constant or linear over much of the displacement and then the amount of additional collapsing force required rapidly decreases during the final travel of the regulator plates to their final substantially adjacent position. This is due to an increasing variable spring factor $f(d)$ of the regulator system.

Figure 3:
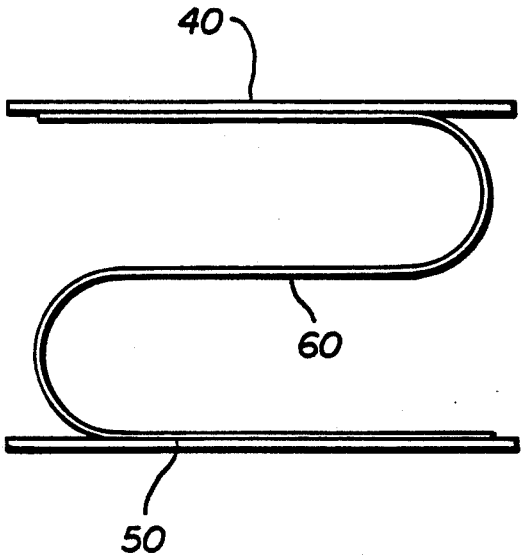
FIG. 3 is an end elevation view of the regulator of FIG. 2.
Figure 4:
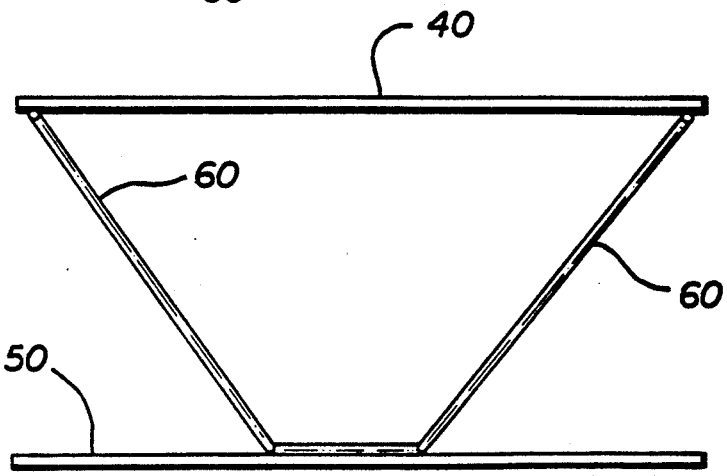
FIG. 4 is a front elevation view of the regulator of FIG. 2.

FIG. 3 is an end elevation view of the presently preferred embodiment of pressure regulator constructed of a pair of spaced sideplates and a serpentine wire spring 60 of piano wire welded or attached by clips (not shown) to each end of one (the upper sideplate 40 as seen in FIG. 4) of the sideplates. As the spring collapses, the amount of additional collapsing force required gradually diminishes as the regulator is fully collapsed.

FIG. 5 shows that the amount of force F required to collapse a prior art regulator increases relatively linearly as the prior art compression spring 60 collapses from a spacing of the sideplates from 16 mm down to 0 mm. In comparison, the force required to collapse a regulator constructed according to the present invention its last few millimeters of travel is considerably less than the force required by the prior art. In the first part of travel, both the prior art regulator and regulators constructed as taught herein follow essentially the same force/deflection curve. It should be noted that except for the first part of travel where a slightly increased amount of force is required to overcome friction imparted by the ink bag, the force/deflection curve is essentially linear. The final part of the curve exhibited by regulators constructed according to the present invention is substantially flatter than the prior art regulator curve and this is desirable since it enhances printing regardless of whether the ink is fired vertically or horizontally from the print head cartridge. These deflection characteristics are attained primarily by configuring the spring in a selected geometrical shape. Although a serpentine shape is shown, persons skilled in the art given the teachings of this disclosure may be able to configure other arrangements to obtain the desired variable force during spring collapse. One such mechanical equivalent is illustrated schematically in FIG. 6 wherein a pair of hinged links 70, 80 disposed between the plates 40, 50 are urged by compression springs 60 to bias the piston plates apart from each other. As seen therein, the springs need not necessarily be positioned between the plates. The end result is a substantially complete evacuation of ink from the flexible bag since, unlike prior art arrangements, substantial collapsing forces are not required at the end of travel of the regulator to its collapsed condition.

Persons skilled in the art will readily appreciate that various modifications can be made from the preferred embodiment thus the scope of protection is intended to be defined only by the limitations of the appended claims.

I claim:

1. A pressure regulator system for a liquid ink cartridge having an ink reservoir to be maintained under negative pressure, said reservoir having a pair of walls, at least one of which is moveable with respect to the other wall, said regulator system comprising:

a) a pair of spaced substantially parallel flat side plates respectively engageable with said walls of said reservoir; and b) a spring system urging said plates apart from each other, said spring system having a variable spring function $f(x)$ in a spring equation $F=(f(x)x$ which increases with travel of the plates toward each other where F is spring force and x is spring deflection.

2. The pressure regulator of claim 1, wherein said spring system comprises a spring disposed between said plates.

3. The pressure regulator system of claim 2, wherein said spring is resilient wire bent into serpentine configuration.

4. The pressure regulator system of claim 3, wherein said wire is affixed to one of said plates.

5. The pressure regulator of claim 4, wherein said spring is piano wire.

6. The pressure regulator of claim 1, wherein said plates are stainless steel.

7. A printer ink cartridge comprising a rigid housing containing an ink reservoir to be maintained under negative pressure, said reservoir having a pair of substantially parallel walls, at least one of which is moveable with respect to the other wall, and an ink pressure regulator system in said ink reservoir, said regulator system comprising:

a) a pair of spaced substantially parallel flat side plates respectively engageable with said walls of said reservoir; and b) a spring system urging said plates apart from each other, said spring system having a variable spring function f(x) in a spring equation $F=f(x)x$ which increases with travel of the plates toward each other where F is spring force and x is spring deflection.

* * * * *